United States Patent [19]

Pepera

[11] 3,969,819

[45] July 20, 1976

[54] HAIR TRIMMER ATTACHMENT

[76] Inventor: Frank R. Pepera, 4211 Milford Ave., Parma, Ohio 44134

[22] Filed: Oct. 1, 1973

[21] Appl. No.: 402,405

[52] U.S. Cl. ..... 30/200
[51] Int. Cl.[2] ..... B26B 19/38
[58] Field of Search ..... 30/200, 20

[56] References Cited

UNITED STATES PATENTS

| | | | |
|---|---|---|---|
| 1,628,421 | 5/1927 | Patenaude | 30/200 |
| 1,761,550 | 6/1930 | Wahl | 30/201 |
| 1,807,811 | 6/1931 | Osdel | 30/200 |
| 2,481,097 | 9/1949 | Fewins | 30/200 |
| 2,607,985 | 8/1952 | Bush | 30/200 |

*Primary Examiner*—Al Lawrence Smith
*Assistant Examiner*—J. C. Peters
*Attorney, Agent, or Firm*—Baldwin, Egan, Walling & Fetzer

[57] ABSTRACT

For use with a hair trimmer of known design having coacting relatively oscillatable shear plates each provided with a series of generally V-shape cutting teeth and wherein a fixed shear plate is in position to engage the head of the party whose hair is being trimmed and an oscillatable shear plate is in contact therewith, a combination is provided of a removable comb plate clipped onto the bottom of the stationary shear plate and having a series of parallel comb teeth extending forwardly of the cutting teeth and spaced a predetermined distance from the shearing level whereby a person may cut his own hair using the trimmer with the comb attachment so as to cut the individual hairs at at uniform length. The invention includes a plurality of such detachable comb plates so that one might trim his hair say one-quarter of an inch long at a certain distance above his neckline, and then change to another comb plate attachment which would permit him to cut the hair for one-eighth of an inch length extending downwardly from the first cut and so on, to the neckline or other stopping point. A comb plate might be provided to cut to a length of 1/16th or 1/32nd of an inch.

2 Claims, 7 Drawing Figures

HAIR TRIMMER ATTACHMENT

An object of the present invention is to provide a simple but efficient means whereby a person may utilize a standard electrically operated hair trimmer to cut his own hair.

Another object of the invention is to provide quickly attachable and detachable comb plates of simple construction, each arranged to trim the hair to a somewhat different length so that the user may gradually cut his hair to shorter and shorter lengths as he approaches the neckline, or other stopping point.

Other objects and advantages of this invention will be apparent from the accompanying drawings and the specification and the essential features thereof will be set forth in the appended claims.

In the drawings,

FIG. 6 is a plan view similar to FIG. 3 but showing a comb plate in position on the hair trimmer and capable of cutting a different length of hair than the combination of FIGS. 3 and 4; while

This invention is shown in connection with a known electrical clipper or hair trimmer, the one shown being a product of Racine Clipper Company of Milwaukee, Wisconsin, Type 18, Series B. It should be understood that this invention might be applied to any hair clipper of similar style having relatively oscillatable shear plates as herein described.

Figure 1:
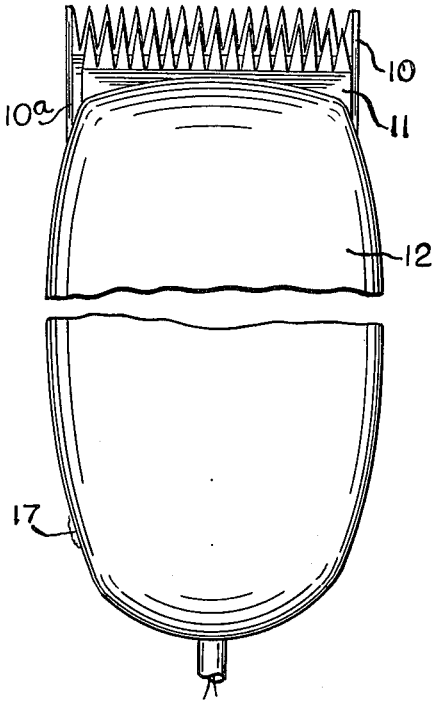
FIG. 1 is a plan view of a known type of electrical hair trimmer for use with this invention.

At one end of the trimmer, a stationary shear plate 10 is attached in fixed position. A second shear plate 11 has a flat surface in engagement with a coacting flat surface of the fixed shear plate 10 and means not shown in the housing 12 of the trimmer is connected with the shear plate 11 to oscillate the same rapidly from side to side. In the position shown in FIG. 1, the plate 11 is in its right-hand position and during oscillation it moves over substantially in line at the opposite end of plate 10 as indicated at the position 10*a*. In the usual fashion, each plate has a series of cutting teeth, generally V-shape in form so arranged that the opposite right-hand and left-hand edges of the teeth cross each other in a well known manner so as to cut hair entrained between the cutting teeth.

Figure 3:
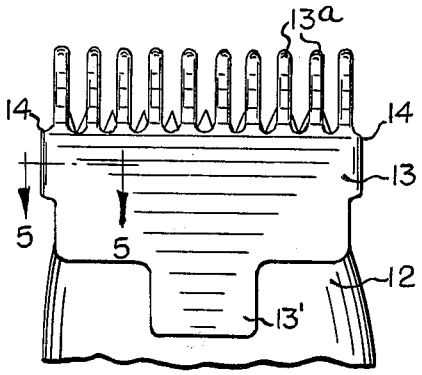
FIG. 3 is a plan view of the cutting end of the hair trimmer of FIGS. 1 and 2 with the comb plate attachment of this invention in position.
Figure 4:
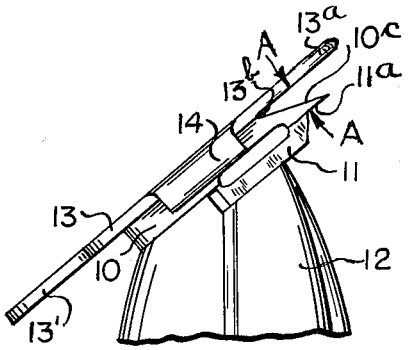
FIG. 4 is a side elevational view of FIG. 3 taken from the right-hand side thereof.
Figure 5:
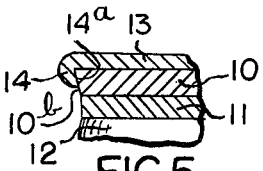
FIG. 5 is an enlarged fragmental sectional view taken along the line 5—5 of FIG. 3.

This invention provides a comb plate removable attachment which consists of a thin flat plate slightly wider than the width of the fixed shear blade 10 and having substantially parallel top and bottom surfaces and a series of parallel comb teeth 13*a* of approximately the thickness of the thin flat plate and extending from the front end thereof. Clip means 14 best seen in FIGS. 3, 4 and 5 are provided at opposite sides of the comb plate, rigid therewith and positioned to slidably embrace opposite ends of the stationary shear plate as the comb is slid during assembly with its top surface flat against the bottom of the stationary shear plate backward from the cutting edge to a position where the comb teeth will guide hairs on a user's head into the cutting teeth. As seen in the drawings, short portions projecting from the opposite sides of the plate 13 are bent upwardly and then inwardly to form the clips 14. Preferably, the side edges of the fixed plate 10 are inclined slightly downwardly and outwardly as shown at 10*b* and the clips 14 having complementary surfaces 14*a* so that the plate 13 is firmly held attached to the plate 10.

In the form of comb plate shown in FIGS. 3 and 4, the teeth 13*a* extend outwardly in the same plane as the plate 13 and, when in position for cutting hair, this leaves a space A between the comb teeth 13*a* and the cutting plane 11*a* between the two shear blades of about one-quarter of an inch. Here the angle between the comb teeth 13*a* and the main plate 13 is zero. In this embodiment, the comb plate 13 is pushed into position until a slight enlargement 13*b*, near the base of teeth 13*a*, forms a stop against the sloping surface 10*c* of the teeth on the shear plate 10.

Figure 6:
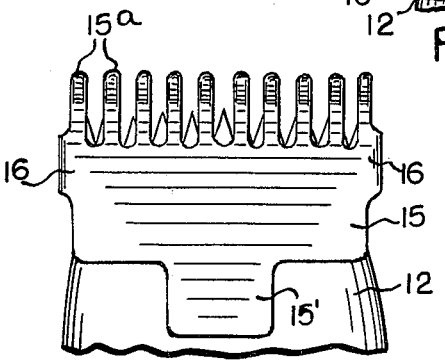
Figure 7:
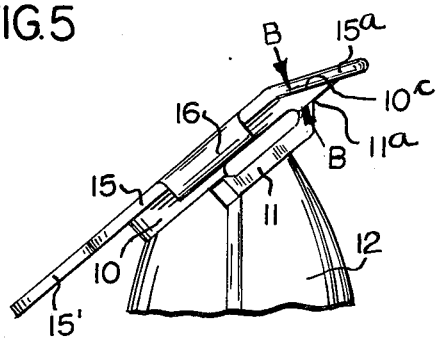
FIG. 7 is a side elevational view of the structure of FIG. 6 taken from the right-hand side thereof.

FIGS. 6 and 7 show another comb plate which may be used in this invention merely by removing the comb plate 13 and substituting the comb plate 15. This is a flat plate having a series of parallel comb teeth 15*a* at its front end of about the same thickness as the plate 15. As best seen in FIG. 7, the teeth 15*a* are bent out of the plane of the plate 15 in a direction toward the fixed shear plate 10 so that when this plate is in use, it is pushed backwardly during assembly with respect to the cutting teeth until the comb teeth 15*a* abut against the inclined surface 10*c* of the fixed shear plate as seen in FIG. 7. At this time, the dimension B between the teeth 15*a* and the shearing level 11*a* between the two shear plates is approximately one-eighth inch. Clips 16 are provided at opposite sides of the comb plate 15 in position to snugly engage the opposite sides of the fixed shear plate 10 in the same fashion as shown in FIG. 5 in connection with plate 13.

It should be noted that there are tongues 14 and 16 which are of a height not to interfere with the oscillation of shear plate 11.

Preferably a handle 13' for the comb plate 13, or a handle 15' for the comb plate 15, are provided for ease in handling.

Figure 2:
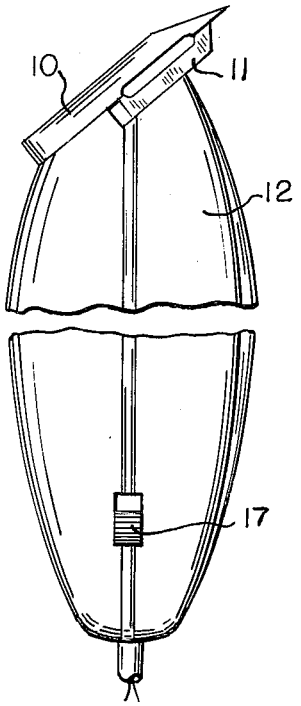
FIG. 2 is an elevational view of the same taken from the left-hand side of FIG. 1.

The button 17 shown in FIG. 2 is moved upwardly to energize the oscillation of the trimmer and downwardly to stop the oscillation.

It should be understood that this invention is not limited to two comb plates but a series of three or more could be provided with the comb teeth at different angles relative to the main plate of the attachment so as to enable the user to cut his hair to longer or shorter lengths depending upon his desire to shape his hair cut as previously mentioned. This invention may be used to trim hair at the back of the head, or back of the ears, or at the temples, or for sideburns, or wherever desired.

What is claimed is:

1. In a hair trimmer comprising a housing and a flat stationary shear plate of predetermined width fixed at one end of said housing and a flat oscillatable shear plate of less than said predetermined width engaging an upper side of said stationary plate and operatively connected with means in said housing for oscillating said oscillatable shear plate relative to said stationary shear plate, said plates having mutually engaging generally parallel cutting teeth extending on one side thereof and adapted to cut hair between them upon said oscillation of said oscillatable shear plate, the combination therewith of a plurality of comb plate attachments which may be interchangeably attached to or detached from said stationary shear plate, each of said attachments, consisting of a thin flat main plate slightly wider than said predetermined width and having substantially parallel top and bottom surfaces and a series of parallel comb teeth of approximately the thickness of said thin flat plate forming a flat portion extending from the front end thereof, and clip means at opposite sides of said comb plate and rigid therewith and positioned to slidably embrace opposite ends of said stationary shear plate as said comb plate is slid into cutting position with its top surface flat against the bottom of said stationary shear plate backward from said cutting teeth to a position where said comb teeth will guide hairs on a user's head into said cutting teeth, in such cutting position said comb teeth and said cutting teeth lying in separate planes, said comb plate attachments varying from each other only in the angle between the comb teeth and the plane of the main plate of the attachments so as to vary the angle between said separate planes, whereby to vary the distance between the attachment teeth and said shear plate, and whereby a user may use said trimmer with the bottom of said comb teeth flat portion of said attachment plate always against his head and whereby a user may smoothly vary the length of cut of his hairs by changing attachment plates to a shorter cut as he approaches his neck line, or other stopping point.

2. A hair trimmer and comb plate attachment as defined in claim 1, wherein said clip means are integral tongues bent up from opposite sides of said thin flat plate and there slightly inward in position to grip snugly said opposite ends of said stationary shear plate, said tongues being of a height not to interfere with said oscillation of said oscillatable shear plate.

* * * * *